US010371437B2

(12) United States Patent
Weber

(10) Patent No.: US 10,371,437 B2
(45) Date of Patent: Aug. 6, 2019

(54) HOUSEHOLD REFRIGERATION DEVICE HAVING AN INTERIOR LIGHTING SYSTEM AND METHOD FOR PRODUCING A HOUSEHOLD REFRIGERATION DEVICE

(71) Applicant: BSH HAUSGERAETE GMBH, Munich (DE)

(72) Inventor: Armin Weber, Lauchheim (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/069,614

(22) PCT Filed: Jan. 31, 2017

(86) PCT No.: PCT/EP2017/051968
§ 371 (c)(1),
(2) Date: Jul. 12, 2018

(87) PCT Pub. No.: WO2017/140487
PCT Pub. Date: Aug. 24, 2017

(65) Prior Publication Data

US 2019/0003764 A1 Jan. 3, 2019

(30) Foreign Application Priority Data

Feb. 19, 2016 (DE) ..... 10 2016 202 567

(51) Int. Cl.
*F21Y 103/10* (2016.01)
*F21V 19/00* (2006.01)
(Continued)

(52) U.S. Cl.
CPC ..... *F25D 27/00* (2013.01); *F21V 19/004* (2013.01); *F21V 33/0044* (2013.01);
(Continued)

(58) Field of Classification Search
CPC ..... F25D 27/00; F25D 11/00; F21V 19/004; F21V 33/0044
See application file for complete search history.

(56) References Cited

U.S. PATENT DOCUMENTS 5,768,898 A * 6/1998 Seok ..... F25D 27/00 362/92
8,459,818 B2 * 6/2013 Becke ..... F25D 27/00 362/154
2009/0046445 A1 2/2009 Namiki et al.

FOREIGN PATENT DOCUMENTS

DE 102010038365 A1 1/2012
DE 102013224261 A1 5/2015
(Continued)

*Primary Examiner* — Thomas M Sember
(74) *Attorney, Agent, or Firm* — Laurence A. Greenberg; Werner H. Stemer; Ralph E. Locher

(57) ABSTRACT

A household refrigeration device includes a heat-insulated body with an inner container which delimits a coolable interior space for storing foodstuffs and has a pocket-shaped recess with a bottom. A refrigeration device cools the coolable interior space. A door panel closes the coolable interior space in a closed state and makes the coolable interior space accessible in an open state. An interior lighting system, which is fastened in the pocket-shaped recess, illuminates the coolable interior space when the door panel is open. The bottom of the pocket-shaped recess includes at least one fastening device, and the interior lighting system has at least one mating fastening device which is fastened on the at least one fastening device. A method for producing a household refrigeration device is also provided.

11 Claims, 9 Drawing Sheets

(51) Int. Cl.

| | |
|---|---|
| ***F21V 33/00*** | (2006.01) |
| ***F25D 11/00*** | (2006.01) |
| ***F25D 27/00*** | (2006.01) |
| ***F21Y 115/10*** | (2016.01) |
| ***F21W 131/305*** | (2006.01) |

(52) U.S. Cl.
CPC ..... *F25D 11/00* (2013.01); *F21W 2131/305* (2013.01); *F21Y 2103/10* (2016.08); *F21Y 2115/10* (2016.08)

(56) References Cited

FOREIGN PATENT DOCUMENTS

| | | | |
|---|---|---|---|
| JP | 2003336963 | A | 11/2003 |
| JP | 2006038083 | A | 2/2006 |
| JP | 2007250268 | A | 9/2007 |
| JP | 200870079 | A | 3/2008 |
| JP | 200889244 | A | 4/2008 |
| KR | 0125937 | Y1 | 11/1998 |
| KR | 200158631 | Y1 | 10/1999 |
| KR | 20000042122 | A | 7/2000 |

* cited by examiner

52

HOUSEHOLD REFRIGERATION DEVICE HAVING AN INTERIOR LIGHTING SYSTEM AND METHOD FOR PRODUCING A HOUSEHOLD REFRIGERATION DEVICE

BACKGROUND OF THE INVENTION

Field of the Invention:

The invention relates to a household refrigeration device having an interior lighting system and to a method for producing a household refrigeration device.

DE 10 2013 224 261 A1 discloses a household refrigeration device which comprises a heat-insulated body with an inner container, a cooling device for cooling the coolable interior and a door panel which is provided to close the coolable interior in the closed state and to make it accessible in the open state. The inner container defines a coolable interior which is provided for storing foodstuffs and includes a pocket-shaped indentation. The household refrigeration device includes an interior lighting system for illuminating the coolable interior when the door panel, which is fastened in the pocket-shaped indentation, is open.

SUMMAR OF THE INENTION

It is the object of the present invention to provide a further household refrigeration device with an interior lighting system which is mountable in a relatively simple manner.

The object of the present invention is achieved by a household refrigeration device, comprising

- a heat-insulated body with an inner container which defines a coolable interior which is provided for storing foodstuffs and which comprises a pocket-shaped indentation with a bottom,
- a cooling device for cooling the coolable interior,
- a door panel which is provided to close the coolable interior in the closed state and to make it accessible in the open state and
- an interior lighting system for illuminating the coolable interior with the door panel open, which door panel is fastened in the pocket-shaped indentation, wherein the bottom of the pocket-shaped indentation comprises at least one fastening device and the interior lighting system comprises at least one counter fastening device which is fastened on the at least one fastening device.

The household refrigeration device according to the invention includes the heat-insulated body with the inner container which defines the coolable interior. Said coolable interior is cooled by means of the cooling device. Said cooling device is preferably realized as a coolant circuit which is known to the expert in principle and is preferably realized in such a manner that it cools the coolable interior to approximately a predetermined temperature. The coolable interior is provided for storing foodstuffs.

The household refrigeration device according to the invention can be, for example, a household cooling device. In this case, the coolable interior is cooled to temperatures higher than 0° C. The household refrigeration device according to the invention can also be a household freezing device. In this case, the coolable interior is cooled to temperatures lower than 0° C. The household refrigeration device according to the invention can, however, also be a freezer-cooler combination. The household refrigeration device according to the invention can comprise precisely one coolable interior, but also several coolable interiors which are also able to be closed and opened in each case by means of a door panel.

The household refrigeration device according to the invention can be realized, in particular, in such a manner that the interior lighting system is only switched on when the door panel is open, that is to say is switched off when the door panel is closed. To this end, the household refrigeration device according to the invention can comprise a door opening switch which is known to the expert in principle.

The household refrigeration device according to the invention can also be realized as a wine cooler which is provided to store bottles filled with drinkable liquid, in particular wine. In this case, the door panel is preferably at least partially transparent by being produced, for example, at least in part from glass.

In this case, in particular, the interior lighting system can illuminate the coolable interior even with the door panel closed.

The interior lighting system is fastened in the pocket-shaped indentation of the inner container. The inner container is preferably produced from plastics material. The indentation can be produced as a result of deep drawing.

The inner container can include two side walls, a ceiling and a rear wall. The interior lighting system can be fastened, for example, on one of the two side walls of the inner container. It is also possible for several interior lighting systems to be fastened on one of the two side walls. Both side walls can also be provided with at least one interior lighting system.

The pocket-shaped indentation is preferably realized in a rectangular and, in particular, elongated manner. It extends, in particular, in the vertical direction over at least part of one of the side walls of the inner container.

The pocket-shaped indentation is provided to receive the interior lighting system or the interior lighting system is provided to be fastened in the pocket-shaped indentation. The pocket-shaped indentation comprises a bottom which is set back in comparison to the surface of the wall in which the pocket-shaped indentation is provided.

The interior lighting system is preferably fastened in the indentation prior to the household refrigeration device according to the invention being foamed with a heat-insulating foam as heat insulation.

The interior lighting system can comprise a housing which is preferably produced from plastics material and is realized, in particular, in one piece. The housing can preferably comprise the at least one counter fastening device. Said counter fastening device is integrally molded on the housing, for example, in one piece. The housing is provided for receiving a light source of the interior lighting system.

At least one LED, in a preferred manner multiple LEDs are preferably used as a light source. The interior lighting system can comprise, for example, a printed circuit board on which the light source is fastened.

According to one embodiment of the household refrigeration device according to the invention, the fastening device is realized as an opening in the bottom of the pocket-shaped indentation, in which opening the counter fastening device is fastened. The opening in the bottom of the pocket-shaped indentation can be produced, for example, as a result of punching. The counter fastening device, for example, is latched with the opening.

According to a preferred variant of the household refrigeration device according to the invention, the opening comprises a first region with a width and a second region which connects directly to the first region with a width which is greater than the width of the first region. The first region is preferably realized in a slit-shaped manner and is then, therefore, a slit-shaped region. The opening comprises, in particular, the form of a keyhole or is realized in a keyhole-shaped manner.

The interior lighting system can comprise an at least partially transparent cover which is fastened to a housing of the interior lighting system and covers said interior lighting system in relation to the coolable interior. The cover preferably runs flush with the inner container and/or hides a gap between the housing of the interior lighting system and the pocket-shaped indentation.

The counter fastening device preferably includes a region and overlapping regions which overlap the region at least at the side. The region is realized, in particular, in a web-shaped manner. The overlapping regions and the region can consequently be realized in a T-shaped manner.

The overlapping regions of the counter fastening device are realized in such a manner that they engage behind the pocket-shaped indentation in the region of lateral edge regions of the first region of the opening. In particular, the overlapping regions of the counter fastening device and the second region of the opening are dimensioned in such a manner that for fastening the interior lighting system in the pocket-shaped indentation, the overlapping regions of the counter fastening device are guidable through the second region of the opening in order then to slide the region of the counter fastening device in such a manner into the first region of the opening that the overlapping regions of the counter fastening device engage behind the pocket-shaped indentation in the region of the lateral edge regions of the first region of the opening. As a result, the interior lighting system can already be fixed in a sufficiently good manner in the pocket-shaped indentation. In addition, this means that the interior lighting system is relatively simple to mount in the pocket-shaped indentation. A further aspect of the invention consequently relates to a method for producing a corresponding household refrigeration device, comprising the following method steps, in order to fasten the interior lighting system in the pocket-shaped indentation:

move the interior lighting system into the pocket-shaped indentation in such a manner that the overlapping regions of the counter fastening device project through the second region of the opening of the fastening device, and then slide the interior lighting system in such a manner that the region of the counter fastening device is slid into the first region of the opening so that the overlapping regions engage behind the pocket-shaped indentation in the region of the lateral edge regions of the first region of the opening.

If the pocket-shaped indentation extends in the vertical direction over at least part of one of the side walls of the inner container, the first region of the opening of the fastening device is then preferably arranged below the second region. In this case, for fastening the interior lighting system, once the overlapping regions of the counter fastening device have been guided through the second region of the opening, the interior lighting system only needs to be slid downward so that the overlapping regions engage behind the pocket-shaped indentation in the region of the lateral edge regions of the first region of the opening.

The overlapping regions can also overlap the region completely. A mushroom-shaped counter fastening device is produced, for example, as a result. In this case, the two overlapping regions are combined to form one common overlapping region.

The counter fastening device in the form of the region and the overlapping regions is realized, in particular, in one piece and is preferably integrally molded on the housing of the interior lighting system, if present.

For an improved hold of the interior lighting system in the pocket-shaped indentation, the region of the counter fastening device can be dimensioned in such a manner that it interacts in a form-locking manner with the first region of the opening.

In addition to this or as an alternative to it, the overlapping regions of the counter fastening device can be realized in such a manner that they interact in a form-locking and/or force-locking manner together with the remaining interior lighting system, and the lateral edge regions of the first region of the opening.

In a preferred manner, at least one of the side overlapping regions, preferably both side overlapping regions of the counter fastening device can also be realized as a prestressed spring in order to press against the pocket-shaped indentation when engaging behind. Said embodiment can then be realized, for example, relatively simply when the region and the overlapping regions of the counter fastening device are realized in a T-shaped manner and, in particular, the region is realized as a web-shaped region and the overlapping regions preferably only overlap the web-shaped region at the side.

The second region includes an edge which is remote from the first region. For improved fixing of the fastened interior lighting system, it preferably includes a latching means which is preferably integrally molded in one piece on the housing. In the fastened state, said latching means presses against the edge of the second region, which edge is remote from the first region.

According to a further embodiment of the household refrigeration device according to the invention, the counter fastening device is realized as an opening in the interior lighting system in which the fastening device is fastened. The counter fastening device is latched, for example, with the opening. The counter fastening device which is realized as an opening is preferably arranged in the housing if present.

The opening of the counter fastening device preferably includes a first region with a width and a second region which connects directly to the first region with a width which is greater than the width of the first region. The first region is preferably realized in a slit-shaped manner, that is to say preferably a slit-shaped region. The opening comprises, in particular, the form of a keyhole or is realized in a keyhole-shaped manner.

The fastening device preferably includes a region and includes overlapping regions which overlap the region at least at the side. The overlapping regions of the fastening device engage behind the interior lighting system in the region of lateral edge regions of the first region of the opening of the counter fastening device. In particular, the overlapping regions of the fastening device and the second region of the opening of the counter fastening device are dimensioned in such a manner that for fastening the interior lighting system in the pocket-shaped indentation, the interior lighting system is movable in such a manner into the pocket-shaped indentation that the overlapping regions of the fastening device project through the second region of the opening in order then to slide the region of the fastening device in such a manner into the first region of the opening that the overlapping regions of the fastening device engage behind the interior lighting system in the region of the lateral edge regions of the first region of the opening. As a result, the interior lighting system is already able to be fixed in a sufficiently good manner in the pocket-shaped indentation.

In addition, this means that the interior lighting system is relatively simple to mount in the pocket-shaped indentation. A further aspect of the invention consequently relates to a method for producing a corresponding household refrigeration device, comprising the following method steps, in order to fasten the interior lighting system in the pocket-shaped indentation:

move the interior lighting system into the pocket-shaped indentation in such a manner that the overlapping regions of the fastening device project through the second region of the opening of the counter fastening device, and then slide the interior lighting system in such a manner that the region of the fastening device is slid into the first region of the opening of the counter fastening device so that the overlapping regions of the fastening device engage behind the lateral edge regions of the first region of the opening of the counter fastening device.

If the pocket-shaped indentation extends in the vertical direction over at least part of one of the side walls of the inner container, the first region of the opening of the counter fastening device is then preferably arranged above the second region. In this case, for fastening the interior lighting, once the overlapping regions of the counter fastening device have been guided through the second region of the opening of the fastening device, the interior lighting system only needs to be slid downward so that the overlapping regions engage behind the pocket-shaped indentation in the region of the lateral edge regions of the first region of the opening. The overlapping regions are then combined to form a common overlapping region.

The overlapping regions can overlap the region completely. A mushroom-shaped fastening device is produced, for example, as a result.

The fastening device in the form of the region and the overlapping regions is realized, in particular, in one piece. The fastening device can preferably be realized as a separate component and can be fastened in the bottom of the pocket-shaped indentation. The fastening device, which is realized as a separate component, is in particular realized in one piece and/or is fastened in particular in a recess in the bottom of the pocket-shaped indentation, in particular by means of a bayonet closure.

The fastening device, which is realized in one piece and is fastened in the recess, can comprise a sealing lip. Said sealing lip is realized, in particular, in such a manner that it presses against the side of the bottom of the pocket-shaped indentation which faces heat insulation of the household refrigeration device.

The opening of the counter fastening device can comprise two second regions which in each case connect directly to the oppositely situated ends of the first region of the opening. The extents of the two second regions of the opening are preferably identical. As a result, it is possible, for example, to realize the interior lighting system, in particular the housing thereof symmetrically to an axis at right angles to a longitudinal axis which is associated with the longitudinal extent of the interior lighting system or of the housing thereof.

If the pocket-shaped indentation extends in the vertical direction over at least part of one of the side walls of the inner container, the two second regions then preferably form an upper and a lower second region. In this case, for mounting, preferably the interior lighting system is preferably moved into the pocket-shaped indentation in such a manner that the overlapping regions of the counter fastening device project through the lower second region of the opening of the fastening device. For the fastening of the interior lighting system, the interior lighting system then only needs to be slid downward so that the overlapping regions engage behind the pocket-shaped indentation in the region of the lateral edge regions of the first region of the opening.

If the pocket-shaped indentation extends in the vertical direction over at least part of one of the side walls of the inner container, the pocket-shaped indentation then forms a lower edge region in its lower region. The pocket-shaped indentation and the interior lighting system are preferably realized in such a manner that in the mounted state of the interior lighting system, it rests in the lower edge region. As a result, the interior lighting system is prevented from sliding downward.

For an improved hold of the interior lighting system in the pocket-shaped indentation, the region of the fastening device can be dimensioned in such a manner that it interacts in a form-locking manner and/or a force-locking manner with the first region of the opening of the counter fastening device.

In addition to this or as an alternative to it, the overlapping regions of the fastening device can be realized in such a manner that they interact in a form-locking and/or force-locking manner together with the bottom of the pocket-shaped indentation and the lateral edge regions of the first region of the opening of the counter fastening device.

Due the household refrigeration device according to the invention, an option for installing the interior lighting system into the pocket-shaped indentation that is relatively simple to implement can be effected. In particular, where the lighting systems are relatively long, they are able to be realized with a relatively simple contour in the inner container in the pocket-shaped indentation, which is produced, for example, as a result of deep drawing.

The interior lighting system is able to be mounted on the inner container in a relatively simple manner, for example by means of a "keyhole latching system". The interior lighting system, in this case, is always inserted first of all, for example, in the "keyhole" and then preferably slid downward and consequently held.

BRIEF DESCRIPTION OF THE SEVERAL VIEWS OF THE DRAWING

Exemplary embodiments of the invention are shown as examples in the accompanying schematic drawings, in which.

DESCRIPTION OF THE INVENTION

Figure 1:
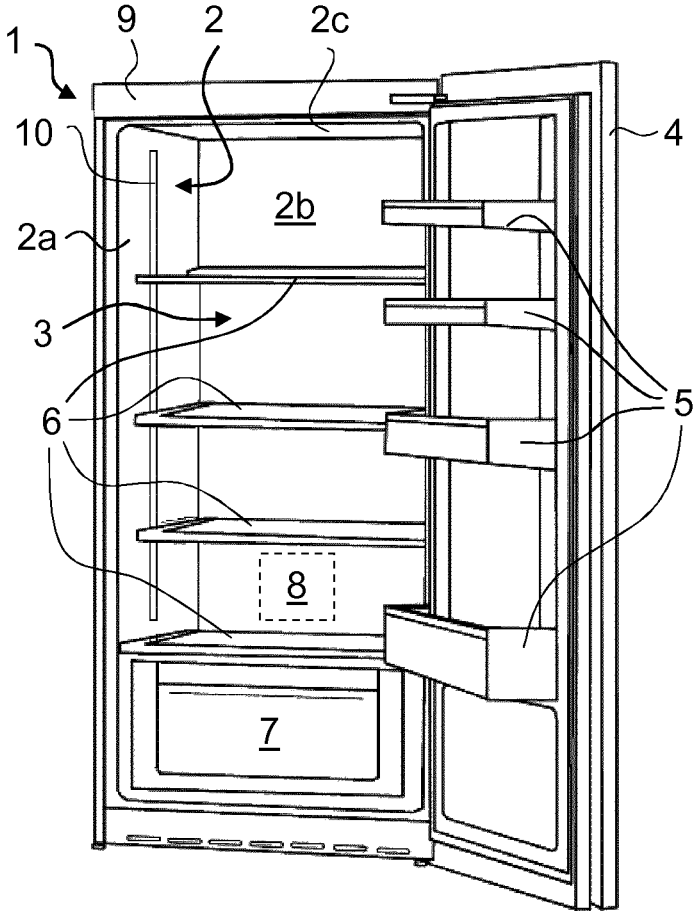
FIG. 1 shows a perspective representation of a household refrigeration device with an inner container and an interior lighting system fastened on the inner container.

FIG. 1 shows a perspective representation of a household refrigeration device 1 which includes a heat-insulated body 9 with an inner container 2. The inner container 2 includes, in particular, two side walls 2*a*, a rear wall 2*b* and a ceiling 2*c* and defines a coolable interior 3 which is provided for storing foodstuffs which are not shown.

The household refrigeration device 1 additionally includes a door panel 4 which is mounted on the body 9 so as to be pivotable, in particular, with reference to a vertically extending axis. When the door panel 4 is open, the coolable interior 3 is accessible.

In the case of the present exemplary embodiment, several door racks 5 for storing foodstuffs are arranged on the side of the door panel 4 which is directed in the direction of the coolable interior 3. Several shelves 6 for storing foodstuffs are arranged, in particular, in the coolable interior 3 and in the lower region of the coolable interior 3, in particular, a drawer 7 is arranged in which foodstuffs can also be stored.

The household refrigeration device 1 includes a cooling device which is not shown in any more detail and is known in principle to the expert, preferably in the form of a coolant circuit for cooling the coolable interior 3.

The household refrigeration device 1 can be realized as a so-called no-frost household refrigeration device. The household refrigeration device 1 is, in particular, a household cooling device.

The household refrigeration device 1 can also be realized as a so-called wine cooler. In this case, the foodstuffs are preferably bottles filled with wine or another drinkable liquid. The door panel 4, in this case, is preferably at least partially transparent. It is produced, for example, at least partially from glass. In this case, it can be provided, for example, that door racks 5 are not arranged on the door panel 4.

The household refrigeration device 1, in the case of the present exemplary embodiment, includes a control device 8, which includes, for example, electronics and is set up to control the cooling device, in particular a compressor of the cooling circuit in a manner generally known to the expert in such a manner that the coolable interior 3 is at least approximately at a predetermined or predeterminable required temperature. The control device 8 is preferably set up in such a manner that it regulates the temperature of the coolable interior 3. In order, where applicable, to maintain the actual temperature of the coolable interior 3, the household refrigeration device 1 can comprise at least one temperature sensor which is not shown in any more detail and is connected to the control device 8.

Figure 2:
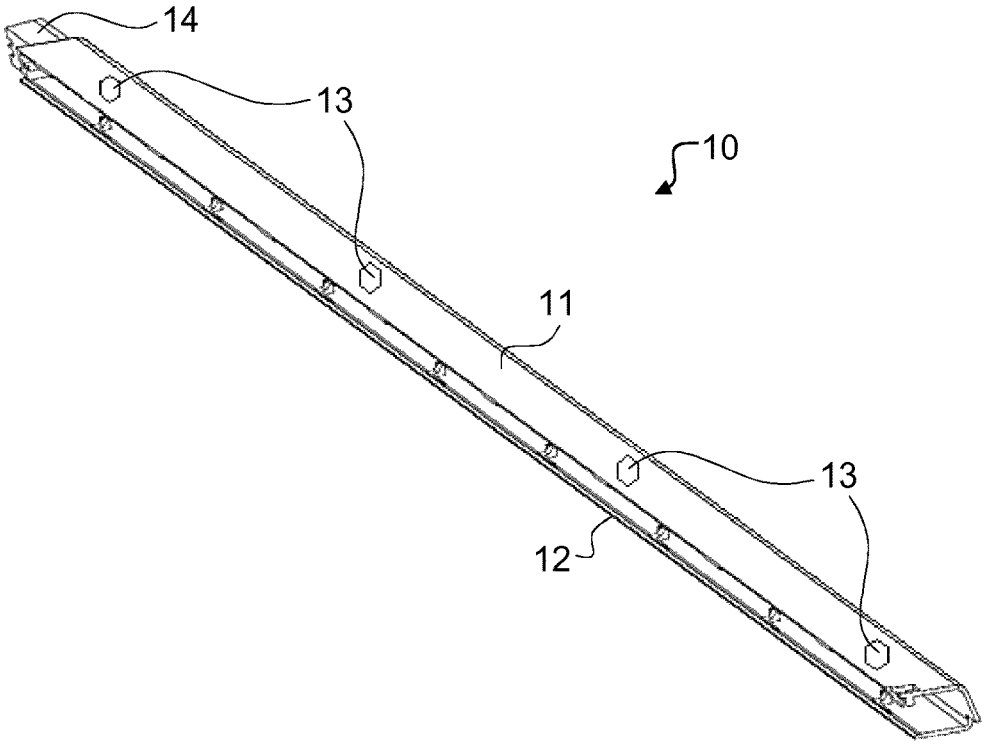
FIG. 2 shows a partially sectioned perspective representation of the interior lighting system.

In the case of the present exemplary embodiment, the household refrigeration device 1 includes at least one interior lighting system 10 which is provided to illuminate the coolable interior 3, preferably simply when the door panel 4 is open. For this purpose, the household refrigeration device 1 can include a door opening switch, which is not shown in any more detail. If the household refrigeration device 1 is realized as a wine cooler, it can then also be provided that the interior lighting system 10 also illuminates the coolable interior 3 when the door panel 4 is closed. A partially sectioned perspective representation of the interior lighting system 10 is shown in FIG. 2.

Figure 3:
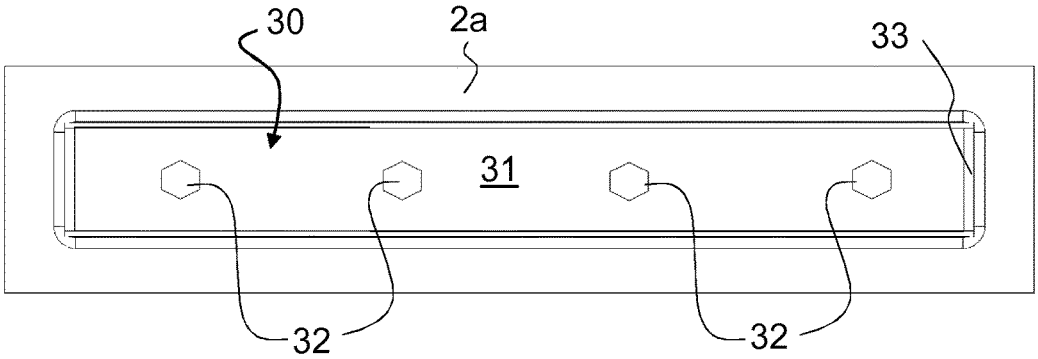
FIG. 3 shows a pocket-shaped indentation in an inner container of the household refrigeration device for receiving the interior lighting system.

In the case of the present exemplary embodiment, the interior lighting system 10 is fastened in a pocket-shaped indentation 30. The pocket-shaped indentation 30 is part of the inner container 2 and is arranged, in particular, as a result of corresponding deep drawing, in one of the side walls 2*a* of the inner container 2. The pocket-shaped indentation 30 is shown in FIG. 3.

The household refrigeration device 1 can also comprise several interior lighting systems 10 which are preferably realized in an identical manner. The interior lighting systems 10 are each fastened in corresponding pocket-shaped indentations 30 of the inner container 2. In particular, one of the side walls 2*a* can comprise several pocket-shaped indentations 30 which preferably extend in a vertical manner and in each of which one of the interior lighting systems 10 is fastened. It can also be provided that both side walls 2*a* are provided with at least one interior lighting system 10.

The interior lighting system 10 extends in particular in the vertical direction over at least part of the side wall 2*a* of the inner container 2. Consequently, the pocket-formed indentation 30 also extends in the vertical direction.

In the case of the present exemplary embodiment, the interior lighting system 10 or each interior lighting system 10 includes a housing 11 which is preferably realized in one piece and in which at least one light source (not shown in any more detail) of the interior lighting system 10 is arranged. The at least one light source is preferably realized as LEDs. The housing 11 of the interior lighting system 10 is preferably produced from plastics material.

In the case of the present exemplary embodiment, the interior lighting system 10 includes a contacting device 14 for electrically contacting the light source.

Figure 4:
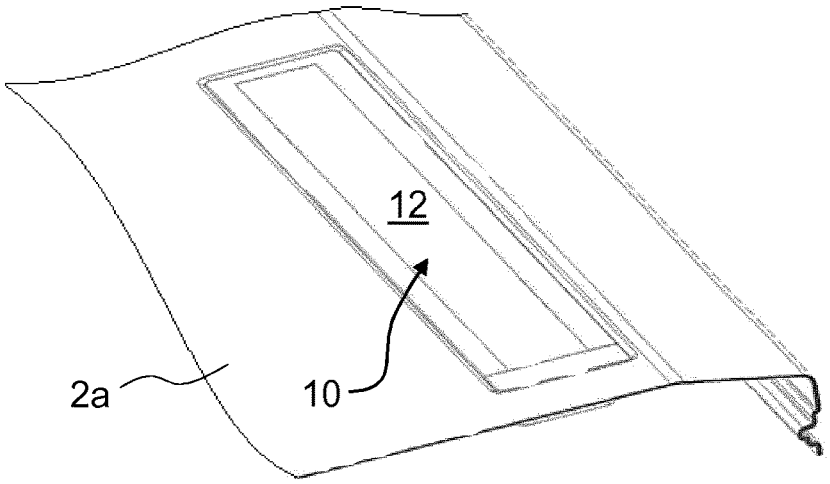
FIG. 4 shows the interior lighting system in the mounted state.

The interior lighting system 10 includes, in the case of the present exemplary embodiment, a semi-transparent cover 12 for the light of the light source. FIG. 4 shows the interior lighting system 10 fastened in the pocket-shaped indentation 30.

The pocket-shaped indentation 30 includes a bottom 31 which consequently extends set back with respect to the surface of the corresponding side wall 2*a*. At least one fastening device 32, by way of which the interior lighting system 10 is fastened in the pocket-formed indentation 30, is arranged in or on the bottom 31 of the pocket-shaped indentation 30.

The vertically aligned pocket-shaped indentation 30 includes a lower edge region 33 and an opening 34 which is provided for guiding through the contacting device 14.

The interior lighting system 10 includes at least one counter fastening device 13, by way of which the interior lighting system 30 is fastened on the corresponding at least one fastening device 32 of the pocket-shaped indentation 30. The at least one counter fastening device 13 can be integrally molded in one piece on the housing 11 of the interior lighting system 10.

FIGS. 5 to 11 show a first embodiment of the interior lighting system 10 or of the pocket-shaped indentation 30, where the fastening device 32 is realized essentially as an opening 50 in the bottom 31 of the pocket-shaped indentation 30 and the counter fastening device 13 of the interior lighting system 10 is fastened in or on the opening 50.

The opening 50 can be produced, for example, as a result of being punched out. The opening 50 is realized, for example, in a keyhole-shaped manner.

Figure 5:
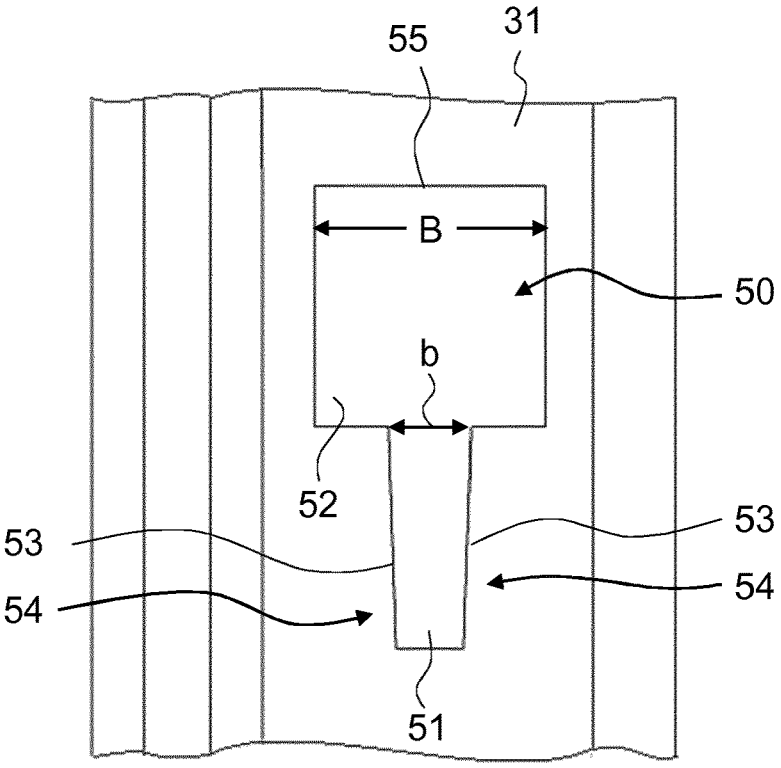
FIG. 5 shows a first embodiment of a fastening device of the pocket-shaped indentation for the fastening of the interior lighting system.

The opening 50 is shown in more detail in the top view in FIG. 5 and includes, in the case of the present exemplary embodiment, a, for example, slit-shaped first region 51 with a width b and a second region 52 which connects directly to the first region 51. The second region 52 is wider than the first region 51, i.e. the width B of the second region 52 is greater than the width b of the first region 51.

The first region 51 preferably extends vertically and is situated, in particular, below the second region 52.

The first region 51 comprises lateral edges 53 with edge regions 54.

The second region 52 includes an edge 55 which is remote from the first region.

Figure 6:
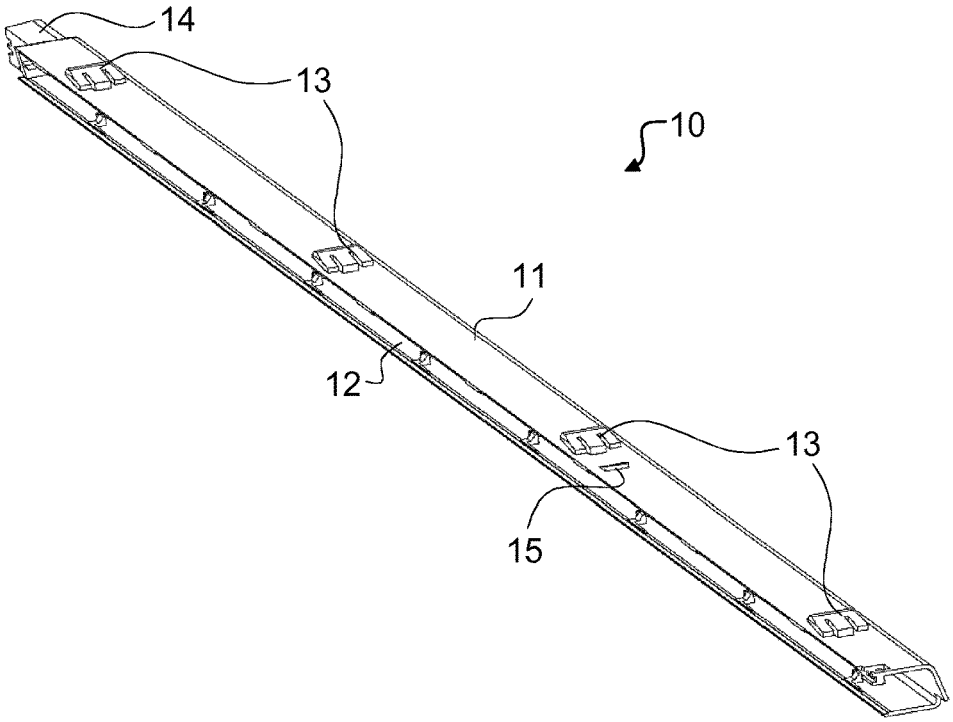
FIG. 6 shows a partially sectioned perspective representation of a first embodiment of the interior lighting system.
Figure 7:
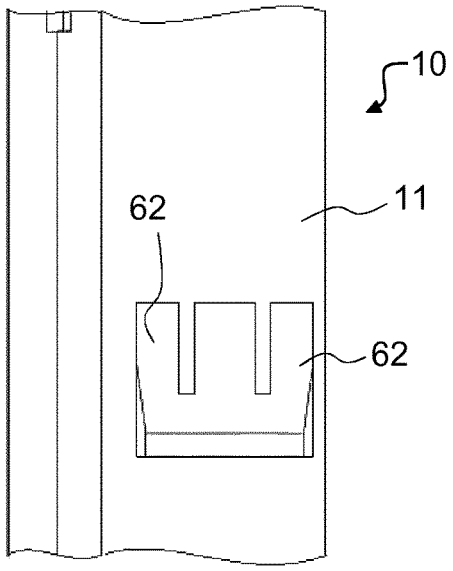
FIGS. 7,8 show a first embodiment of a counter fastening device of the interior lighting shown in FIG. 6 for the fastening device shown in FIG. 5, FIGS. 9,10 show perspective representations of the first embodiment of the interior lighting system fastened in the pocket-shaped indentation.
Figure 8:
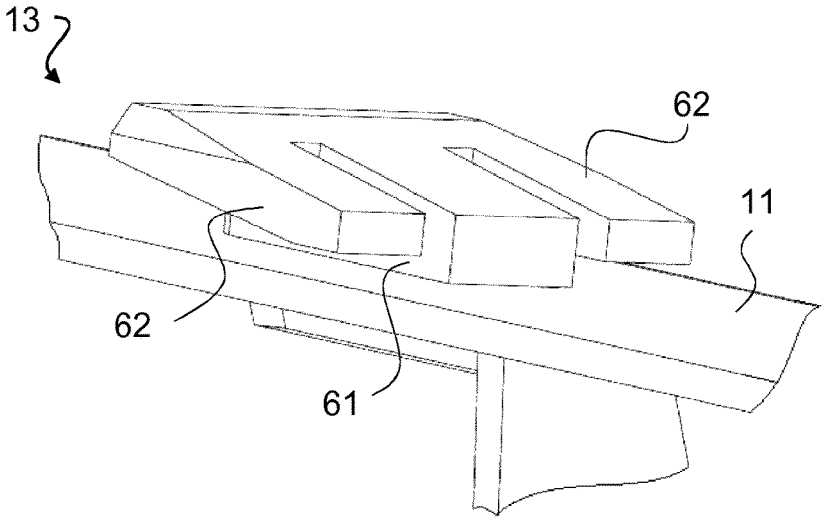
Figure 9:
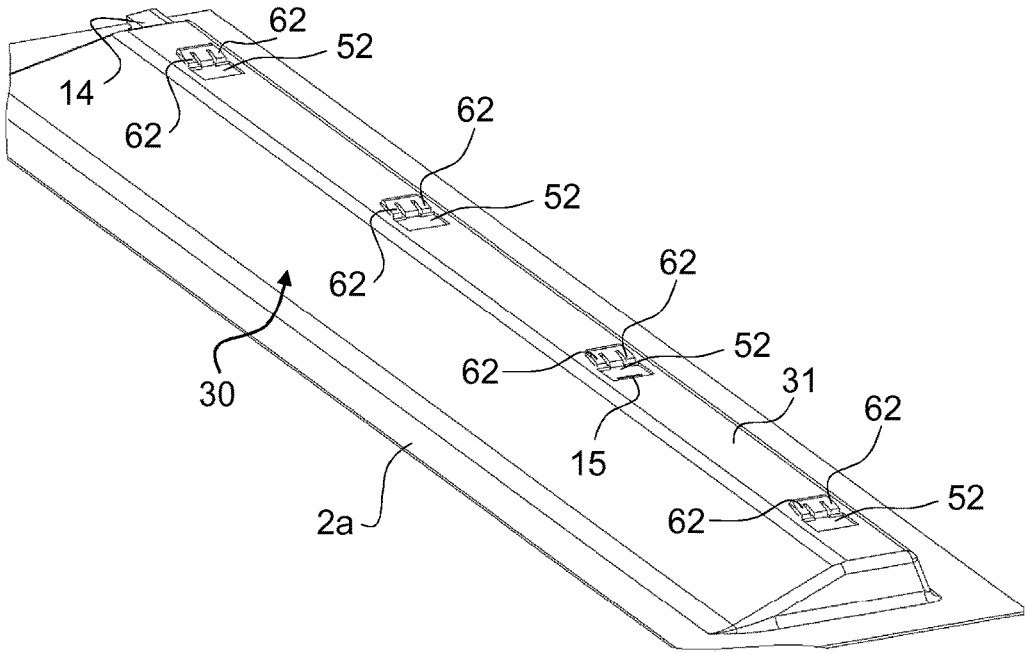
Figure 10:
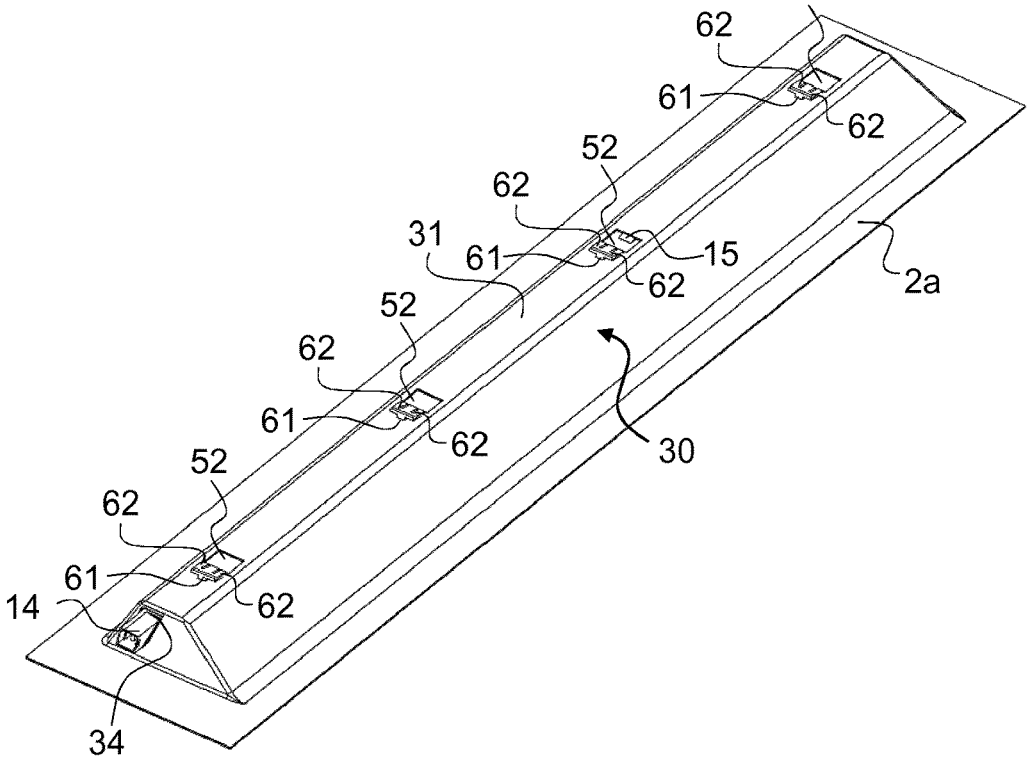
Figure 11:
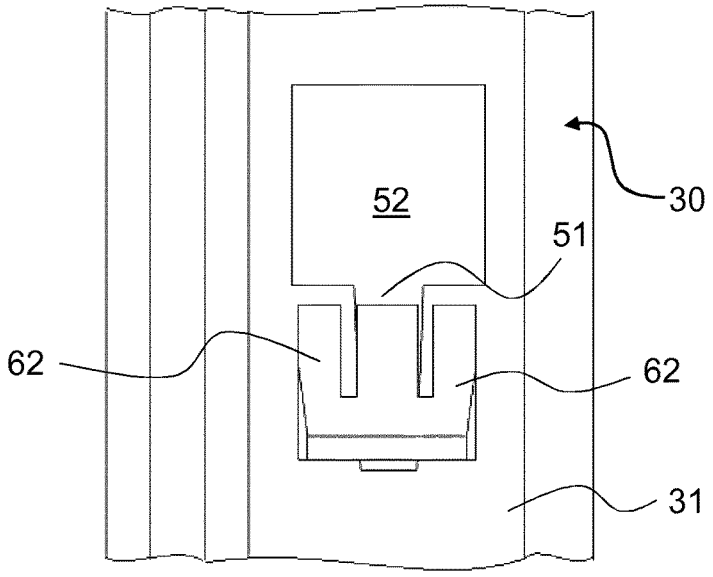
FIG. 11 shows a top view of the counter fastening device of the first embodiment which interacts with the fastening device.

The interior lighting system 10 according to the first exemplary embodiment is shown as a partially sectioned perspective representation in FIG. 6. A top view of the counter fastening device 13 of the first embodiment is shown in FIG. 7. FIG. 8 shows a perspective representation of the counter fastening device 13 according to the first embodiment. FIGS. 9 and 10 show the rear sides of the pocket-shaped indentation 30 with the interior lighting system 10 according to the first embodiment fastened therein, that is to say from the side which faces heat insulation of the household refrigeration device 1. FIG. 11 shows a top view of the counter fastening device 13 which is fastened in the opening 50.

The interior lighting system 10 according to the first embodiment includes a region, which, in the case of the present exemplary embodiment, is realized as a web-shaped region 61, and overlapping regions 62 which overlap said region or the web-shaped region 61 at the side. The web-shaped region 61 and the overlapping regions 62 of the counter fastening device 13 are realized, in particular, in a T-shaped manner. In particular, the overlapping regions 62 only overlap the web-shaped region 61 at the side.

The overlapping regions 62 and the second region 52 of the opening 50 are dimensioned in such a manner that for fastening the interior lighting system 10, the overlapping regions 62 can be guided through the second region 52 of the opening 50 in order then to slide the web-shaped region 61 in such a manner into the first region 51 of the opening 50 that the overlapping regions 62 engage behind the pocket-shaped indentation 30 in the region of the lateral edge regions 54 of the first region 51 of the opening 50.

The web-shaped region 61 is preferably dimensioned in such a manner that it interacts in a form-locking manner with the first region 51 of the opening 50.

The overlapping regions 62 are preferably realized in such a manner that they interact in a form-locking manner and/or a force-locking manner together with the remaining interior lighting system 10 or with the housing 11 thereof and with the lateral edge regions 54 of the first region 51 of the opening 51.

At least one of the overlapping regions 62 is preferably realized as a prestressed spring for improved grip in order to press against the pocket-shaped indentation 30 in the edge region 54 of the first region 51 of the opening 50 when engaging behind.

For improved fixing of the fastened interior lighting system 10 according to the first embodiment, said interior lighting system preferably includes a latching means 15 which is preferably integrally molded in one piece on the housing 11. In the fastened state, said latching means 15 presses against the edge 55 of the second region 52 which is remote from the first region 51.

In the case of the present exemplary embodiment, the fastened interior lighting system 10 rests by way of its housing 11 on the lower edge region 33.

FIGS. 12 to 17 show a second embodiment.

Figure 12:
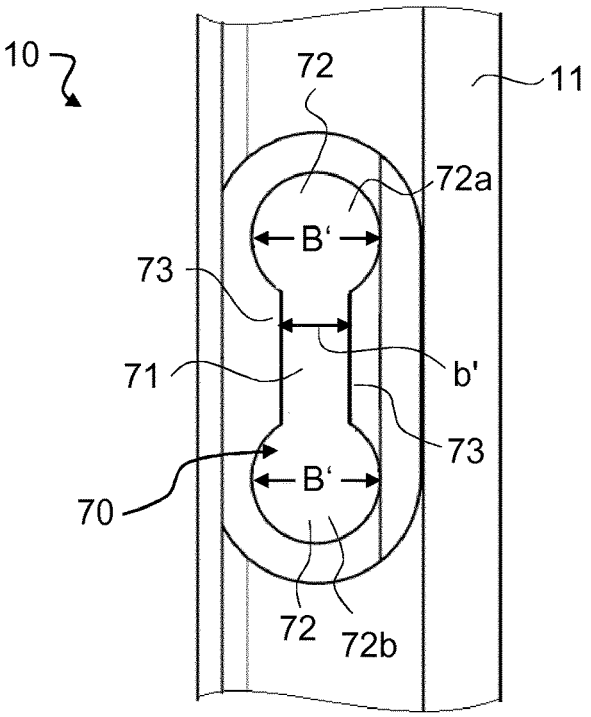
FIG. 12 shows a second embodiment of a counter fastening device.

The counter fastening device 13 of the second embodiment is shown in FIG. 12 and is realized substantially as an opening 70 in the interior lighting system 10, preferably in the housing 11 thereof. The fastening device 32 of the pocket-shaped indentation 30 is fastened in or on said opening 70.

The opening 70 of the counter fastening device 13 includes, in the case of the present exemplary embodiment, a, for example, slit-shaped first region 71 with a width b' and a second region 72 which connects directly to the first region 71. The second region 72 is wider than the first region 71, i.e. the width B' of the second region 72 is greater than the width b' of the first region 71. The opening 70 preferably includes two second regions 72 which each connect directly to the oppositely situated sides of the first region 71 of the opening 70. The extent of the second regions 72 of the opening 70 are preferably identical.

The first region 71 preferably extends in a vertical manner. The first region 71 comprises lateral edges with edge regions 73.

The interior lighting system 10 and consequently the pocket-shaped indentation 30 preferably extend in a vertical manner. Consequently, one of the two upper regions 72 is an upper second region 72*a* and the other second region is a lower second region 72*b*.

Figure 13:
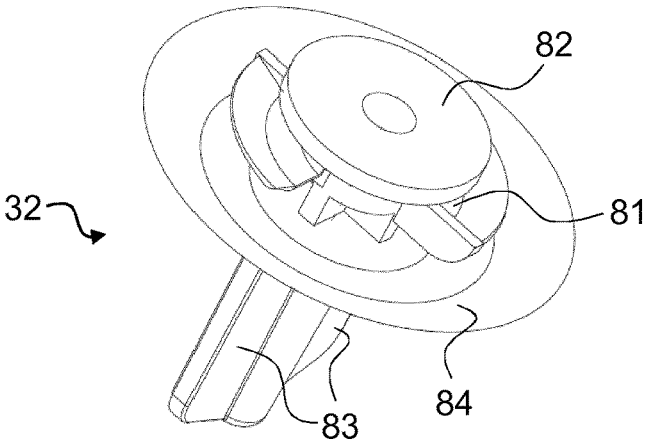
FIG. 13 shows a sectioned representation of a second embodiment of a fastening device realized as a separate component.

The fastening device 13 of the second embodiment, which is shown in a perspective representation in FIG. 13, includes a region 81 and overlapping regions 82 which overlap said region 81. The fastening device 32 is realized, in particular, in a mushroom-shaped manner such that the region 81 of the fastening device 32 provides the "stalk" and the overlapping regions 82 provide part of the "mushroom head" and consequently overlap the region 81 completely. In said case, the overlapping regions 82 are combined to form a common overlapping region.

The overlapping regions 82 and the second region 72 of the opening 70 are dimensioned in such a manner that for fastening the interior lighting system 10, the overlapping regions 82 can be guided through the second region 72 of the opening 70 in order then to slide the region 81 of the fastening device 32 in such a manner into the first region 71 of the opening 70 that the overlapping regions 82 engage behind the interior lighting system 10 or the housing 11 thereof in the region of the lateral edge regions 73 of the first region 71 of the opening 70.

The pocket-shaped indentation 30 forms the lower edge region 33 in its lower region. The pocket-shaped indentation 30 and the interior lighting system 10 are preferably realized in such a manner that with the interior lighting system 10 in the mounted state, it abuts against the lower edge region 33. As a result, the interior lighting system 10 is prevented from sliding downward.

In the case of the present exemplary embodiment, the region 81 of the fastening device 32 is dimensioned in such a manner that it interacts in a form-locking manner with the first region 71 of the opening 70. In addition, in the case of the present exemplary embodiment, the overlapping regions 82 are realized in such a manner that they interact in a form-locking and force-locking manner with the lateral edge regions 73 of the first region 71 of the opening 70 and with the bottom 31 of the pocket-shaped indentation 30.

In the case of the present exemplary embodiment, the fastening device 32 is produced as a separate component and is fastened in the bottom 31 of the pocket-shaped indentation 30. Said fastening device 32, which is realized as a separate component, is preferably produced from plastics material and/or in one piece.

Figure 14:
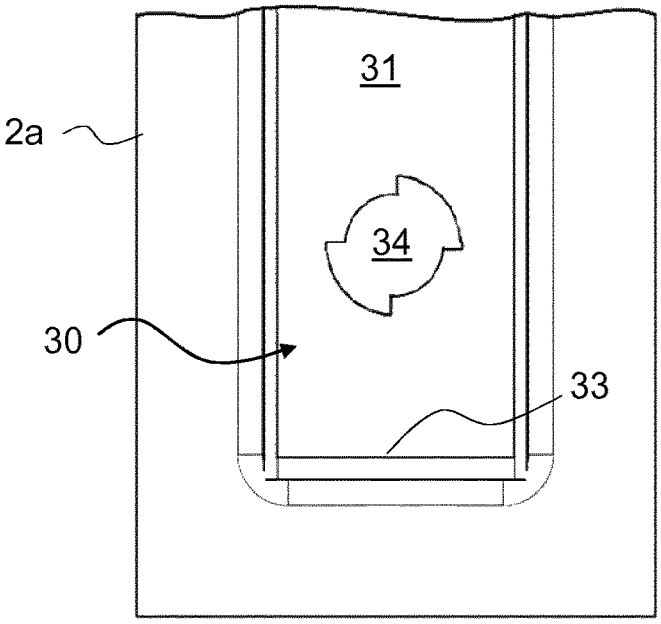
FIG. 14 shows a recess in the bottom of the pocket-shaped indentation.

In the case of the present exemplary embodiment, the fastening device 32, which is realized as a separate component, is fastened in a recess 34, shown in FIG. 14, in the bottom 31 of the pocket-shaped indentation 30, preferably by means of a bayonet closure, which the fastening device 32 and the recess 34 form.

Figure 15:
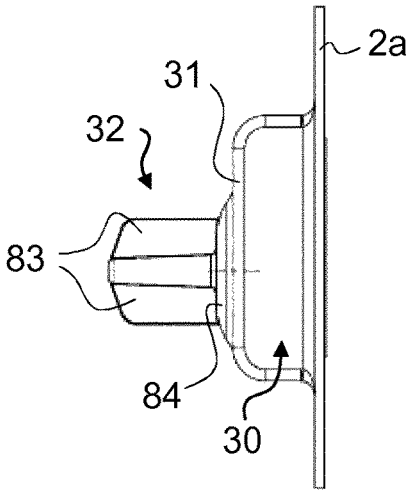
FIG. 15 shows a side view of the pocket-shaped indentation with the fastening device.
Figure 16:
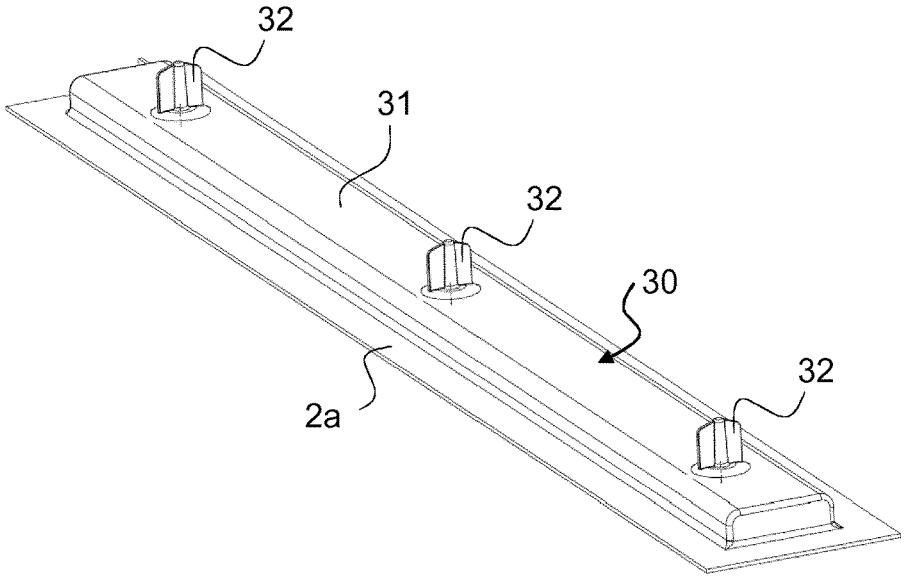
FIG. 16 shows a perspective representation of the pocket-shaped indentation with a fastening device fastened thereon.

FIG. 15 shows a side view seen from the end face of the pocket-shaped indentation 30 with a fastened fastening device 32 and FIG. 16 shows a perspective representation of the pocket-shaped indentation 30 with fastening devices 32 fastened thereon from the side of the pocket-shaped indentation 30 which faces heat insulation of the household refrigeration device 1. In the exemplary embodiment shown in FIG. 16, three fastening devices 32 are fastened in the bottom 31 of the pocket-shaped indentation 30.

In the case of the present exemplary embodiment, the fastening device 32, which is realized as a one-part component, includes wings 83 and a sealing lip 84.

In order to fasten the fastening device 32 on the bottom 31 of the pocket-shaped indentation 30, said fastening device, in the case of the present exemplary embodiment, prior to a foaming of the body 9 with an insulating foam, which provides the heat insulation of the household refrigeration device 1, is moved from the side facing the heat insulation partially through the recess 34 such that the region 81 and the overlapping regions 82 project through the recess 34 and the sealing lip 84 presses against the side of the bottom 31 facing the heat insulation. The fastening device 32 can then be fastened by means of the wings 83 on the recess 34 by means of the bayonet closure.

Figure 17:
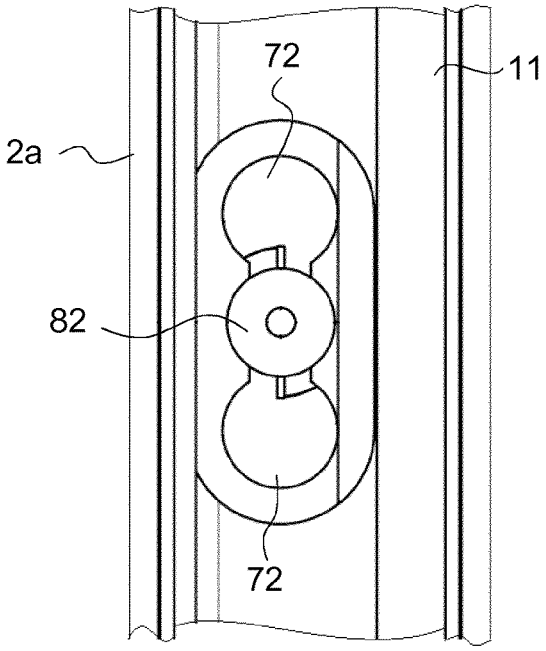
FIG. 17 shows the counter fastening device and the fastening device with the interior lighting system in the fastened state.

FIG. 17 shows the counter fastening device 13 and the fastening device 32 with the interior lighting system 10 in the fastened state, according to the second embodiment.

For fastening the interior lighting system 10, said interior lighting system is moved into the pocket-shaped indentation 30 in such a manner that the overlapping regions 82 of the fastening device 32 project through one of the two second regions 72, preferably through the lower second region 72*b* of the opening 70 of the counter fastening device 13. The interior lighting system 10 is then slid downward in such a manner that the region 81 of the fastening device 32 is slid into the first region 71 of the opening 70 of the counter fastening device 13 so that the overlapping regions 82 engage behind the interior lighting system 10 or the housing 12 thereof in the region of the lateral edge regions 73 of the first region 71 of the opening 70 of the counter fastening device 13.

LIST OF REFERENCES

1 Household refrigeration device
2 Inner container
2*a* Side walls
2*b* Rear wall
2*c* Ceiling
3 Coolable interior
4 Door panel
5 Door racks
6 Shelves
7 Drawer
8 Control device
9 Body
10 Interior lighting system
11 Housing
12 Cover
13 Counter fastening device
14 Contacting device
15 Latching means
30 Pocket-shaped indentation
31 Bottom
32 Fastening device
33 Edge region
34 Opening
50 Opening
51 First region
52 Second region
53 Lateral edges
54 Edge regions
55 Edge
61 Web-shaped region
62 Overlapping regions
70 Opening
71 First region
72 Second region
72*a* Upper second region
72*b* Lower second region
73 Edge regions
81 Region
82 Overlapping regions
83 Wings
84 Sealing lip
b,b',B,B' Width

The invention claimed is:

1. A household refrigeration device, comprising:

a heat-insulated body with an inner container, said inner container defining a coolable interior for storing foodstuffs and said inner container including a pocket-shaped indentation with a bottom, said bottom of said pocket-shaped indentation including at least one fastening device;

a door panel for closing said coolable interior in a closed state and for making said coolable interior accessible in an open state;

an interior lighting system for illuminating said coolable interior with said door panel open, said interior lighting system including at least one counter fastening device being fastened on said at least one fastening device for fastening said interior lighting system in said pocket-shaped indentation;

said fastening device being an opening in said bottom of said pocket-shaped indentation in which said counter fastening device is fastened or latched, said opening of said fastening device including a first region with a width and a second region being directly connected to said first region, said second region having a width being greater than said width of said first region, said first region having lateral edge regions;

said counter fastening device including a region having at least laterally overlapping regions;

said overlapping regions of said counter fastening device engaging behind said pocket-shaped indentation in a region of said lateral edge regions of said first region of said opening of said fastening device; and said overlapping regions of said counter fastening device and said second region of said opening of said fastening device being dimensioned to permit said overlapping regions of said counter fastening device to be guided through said second region of said opening of said fastening device in order to then slide said region of said counter fastening device into said first region of said opening of said fastening device causing said overlapping regions of said counter fastening device to engage behind said pocket-shaped indentation in said region of said lateral edge regions of said first region of said opening of said fastening device, for fastening said interior lighting system in said pocket-shaped indentation.

2. The household refrigeration device according to claim 1, wherein said first region of said opening of said fastening device is a slit, and said region of said counter fastening device is a web.

3. The household refrigeration device according to claim 1, wherein said interior lighting system is fastened in said pocket-shaped indentation by at least one of:

dimensioning said region of said counter fastening device to interact in a form-locking manner with said first region of said opening of said fastening device, or causing said overlapping regions of said counter fastening device to interact together with a remaining portion of said interior lighting system and said lateral edge regions of said first region of said opening of said fastening device in at least one of a form-locking or force-locking manner, or pressing at least one of said overlapping regions of said counter fastening device as a prestressed spring against said pocket-shaped indentation when engaging behind.

4. A household refrigeration device, comprising:

a heat-insulated body with an inner container, said inner container defining a coolable interior for storing foodstuffs and said inner container including a pocket-shaped indentation with a bottom, said bottom of said pocket-shaped indentation including at least one fastening device;

a door panel for closing said coolable interior in a closed state and for making said coolable interior accessible in an open state;

an interior lighting system for illuminating said coolable interior with said door panel open, said interior lighting system including at least one counter fastening device being fastened on said at least one fastening device for fastening said interior lighting system in said pocket-shaped indentation, said counter fastening device being an opening in said interior lighting system in which said fastening device is fastened or latched;

said opening of said counter fastening device including a first region having a width and a second region directly connected to said first region, said second region having a width being greater than said width of said first region, said first region having lateral edge regions;

said fastening device including a region having laterally overlapping regions, said overlapping regions of said fastening device engaging behind said interior lighting system in a region of said lateral edge regions of said first region of said opening; and said overlapping regions of said fastening device and said second region of said opening being dimensioned to permit said interior lighting system to be moved into said pocket-shaped indentation causing said overlapping regions of said fastening device to project through said second region of said opening in order to then slide said region of said fastening device into said first region of said opening to cause said overlapping regions of said fastening device to engage behind said interior lighting system in said region of said lateral edge regions of said first region of said opening, for fastening said interior lighting system in said pocket-shaped indentation.

5. The household refrigeration device according to claim 4, wherein said first region of said opening is a slit.

6. The household refrigeration device according to claim 4, wherein said first region of said opening has oppositely situated ends, and said second region of said opening is one of two second regions each being connected directly to a respective one of said oppositely situated ends of said first region of said opening.

7. The household refrigeration device according to claim 4, wherein said two second regions of said opening have identical extents.

8. The household refrigeration device according to claim 4, wherein said interior lighting system is fastened in said pocket-shaped indentation by at least one of:

dimensioning said region of said fastening device to interact in a form-locking manner with said first region of said opening of said counter fastening device, or causing said overlapping regions of said fastening device to interact together with said bottom of said pocket-shaped indentation and said lateral edge regions of said first region of said opening of said counter fastening device in at least one of a form-locking or force-locking manner, or fastening said fastening device as a separate component in said bottom of said pocket-shaped indentation.

9. The household refrigeration device according to claim 8, wherein said fastening device is fastened in a recess in said bottom of said pocket-shaped indentation by a bayonet closure.

10. A method for producing a household refrigeration device, the method comprising the following steps:

providing a heat-insulated body with an inner container, the inner container defining a coolable interior for storing foodstuffs and the inner container including a pocket-shaped indentation with a bottom, the bottom of the pocket-shaped indentation including at least one fastening device;

providing a door panel for closing the coolable interior in a closed state and for making the coolable interior accessible in an open state;

providing an interior lighting system for illuminating the coolable interior with the door panel open, the interior lighting system including at least one counter fastening device being fastened on the at least one fastening device for fastening the interior lighting system in the pocket-shaped indentation;

providing the at least one fastening device with an opening including a first region with a width and a second region being directly connected to the first region, the second region having a width being greater than the width of the first region, the first region having lateral edge regions;

providing the at least one counter fastening device with a region having at least laterally overlapping regions; and fastening the interior lighting system in the pocket-shaped indentation by:

moving the interior lighting system into the pocket-shaped indentation and projecting the overlapping regions of the counter fastening device through the second region of the opening of the at least one fastening device; and then sliding the region of the at least one counter fastening device of the interior lighting system into the first region of the opening of the at least one fastening device and engaging the overlapping regions behind the pocket-shaped indention in the region of the lateral edge regions of the first region of the opening of the at least one fastening device.

11. A method for producing a household refrigeration device, the method comprising the following steps:

providing a heat-insulated body with an inner container, the inner container defining a coolable interior for storing foodstuffs and the inner container including a pocket-shaped indentation with a bottom, the bottom of the pocket-shaped indentation including at least one fastening device;

providing a door panel for closing the coolable interior in a closed state and for making the coolable interior accessible in an open state;

providing an interior lighting system for illuminating the coolable interior with the door panel open, the interior lighting system including at least one counter fastening device being fastened on the at least one fastening device for fastening the interior lighting system in the pocket-shaped indentation;

providing the at least one counter fastening device with an opening including a first region having a width and a second region directly connected to the first region, the second region having a width being greater than the width of the first region, the first region having lateral edge regions;

providing the at least one fastening device with a region having laterally overlapping regions, the overlapping regions of the fastening device engaging behind the interior lighting system in a region of the lateral edge regions of the first region of the opening; and fastening the interior lighting system in the pocket-shaped indentation by:

moving the interior lighting system into the pocket-shaped indentation and projecting the overlapping regions of the at least one fastening device through the second region of the opening of the counter fastening device; and then sliding the region of the at least one fastening device into the first region of the opening of the at least one counter fastening device and engaging the overlapping regions of the fastening device behind the lateral edge regions of the first region of the opening of the at least one counter fastening device.

* * * * *